United States Patent [10]

George

[11] 4,052,806

[45] Oct. 11, 1977

[54] DISPLAY DEVICE WITH ADJUSTABLE ATTACHMENT MEANS

[75] Inventor: James Rembrandt George, Garden City, N.Y.

[73] Assignee: Vango Media, Inc., New York, N.Y.

[21] Appl. No.: 648,275

[22] Filed: Jan. 12, 1976

[51] Int. Cl.[2] ..... E05D 15/20

[52] U.S. Cl. ..... 40/129 C; 362/224; 362/243

[58] Field of Search ..... 40/129 C, 129 R; 240/7.1, 8.1–8.12, 7.1 C

[56] References Cited

U.S. PATENT DOCUMENTS

| | | | |
|---|---|---|---|
| 2,559,163 | 7/1951 | MacDonald | 40/129 C |
| 3,242,329 | 3/1966 | Abrams | 40/129 C |
| 3,274,548 | 9/1966 | Brimsek | 40/129 C |
| 3,290,813 | 12/1966 | Rose, Sr. | 40/129 C |
| 3,318,031 | 5/1967 | Whaley et al. | 40/129 C |

FOREIGN PATENT DOCUMENTS

| | | | |
|---|---|---|---|
| 1,145,021 | 3/1969 | United Kingdom | 40/129 C |

*Primary Examiner*—E. H. Eickholt
*Attorney, Agent, or Firm*—Pennie & Edmonds

[57] ABSTRACT

A display device for displaying information bearing material having a side portion for supporting the material for viewing by the general public. The device includes an illuminating means located behind the side portion so that the information bearing material can be illuminated from a direction opposite to that from which the material will be viewed by the public.

13 Claims, 5 Drawing Figures

DISPLAY DEVICE WITH ADJUSTABLE ATTACHMENT MEANS

BACKGROUND OF THE INVENTION

In advertising various products, automobiles and other similar vehicles have been employed for carrying and displaying the advertisements. On automobiles these advertisements have typically been a single panel attached to the roof of the automobile extending substantially in a single plane from the front to the rear of the roof. To enhance the display of the advertisements the support structure for the panels have included devices for maintaining light bulbs to illuminate the panel. These light bulbs have been located exterior to and along the periphery of the panel which results in the panel being improperly lighted. Light bulbs supported in this manner create shadows on the panel detracting from its advertising effectiveness. Further, by having the light bulbs external to the panel they are easily damaged by weather and other wear including vandalism to which these devices are often subjected Also, by having the panels extend substantially in a single plane they cannot be properly viewed until the viewer is practically perpendicular to the plane of the panel.

SUMMARY OF THE INVENTION

The invention relates to a display device having at least one surface exposed for viewing by the general public and illuminating the surface by back or rear illumination. More specifically advertising information is placed on surfaces of the device defined by side portions having a slightly convex configuration to provide easy viewing in a multitude of directions. The side portions are supported between two end members, a top portion and a bottom portion and sloping generally away from each other toward the bottom portion. A fluorescent tube is located approximately midway between the top and the bottom portion of the device and the convex sides. By locating the fluorescent tube in this manner every portion of the information bearing surface receives substantially an equal amount of illumination. The bottom portion of the device is provided with attachment means which allow the display device to be secured to the roof of any automobile. A gasket means is fixed to the bottom portion to fit snugly against the roof of the automobile for preventing moisture and other materials from entering into the device along the interface of the gasket and the roof. With this device the internal components are protected from vandalism, moisture and other elements which might interfere with the proper operation in the displaying of the advertising information. This device is one which is economical to manufacture and easy to assemble.

DESCRIPTION OF THE PREFERRED EMBODIMENT

Figure 1:
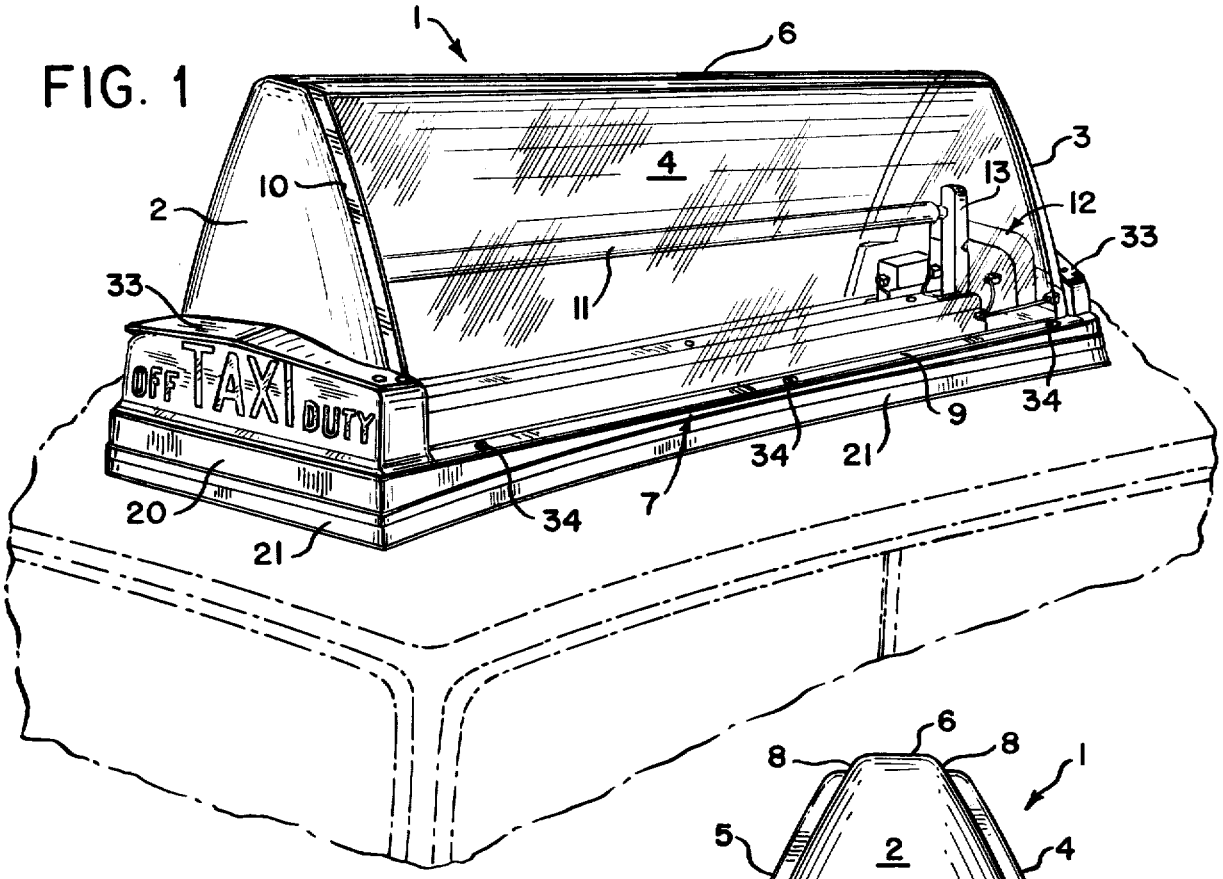
FIG. 1 shows a perspective view of the Back Illuminated Display Device fixed to a roof of a taxicab.

The display device as shown in FIG. 1 is located on the roof of a vehicle which may be a taxicab such that the identifying information, including information relating to whether the cab is "off duty" or in use and the medallion number, faces forwardly and rearwardly relative to the car. A more expansive portion of the device for supporting an advertisement extends laterally for easy viewing by the public.

Figure 2:
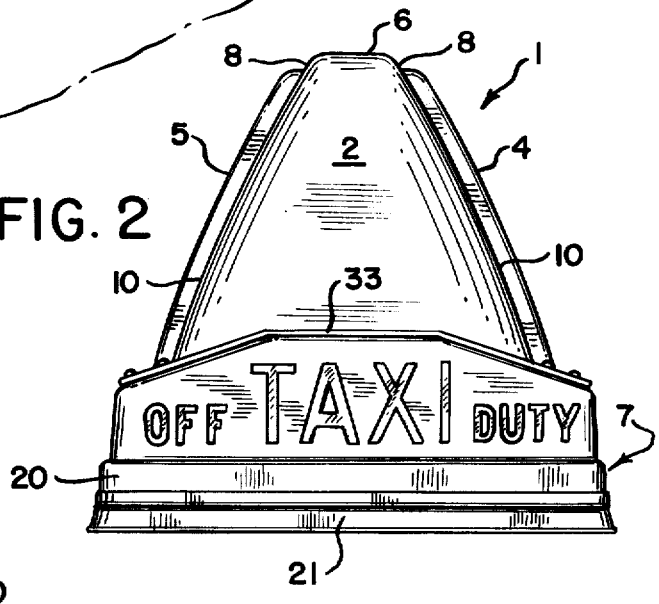
FIG. 2 shows an elevated view of a front end of the Back Illuminated Display Device.
Figure 4:
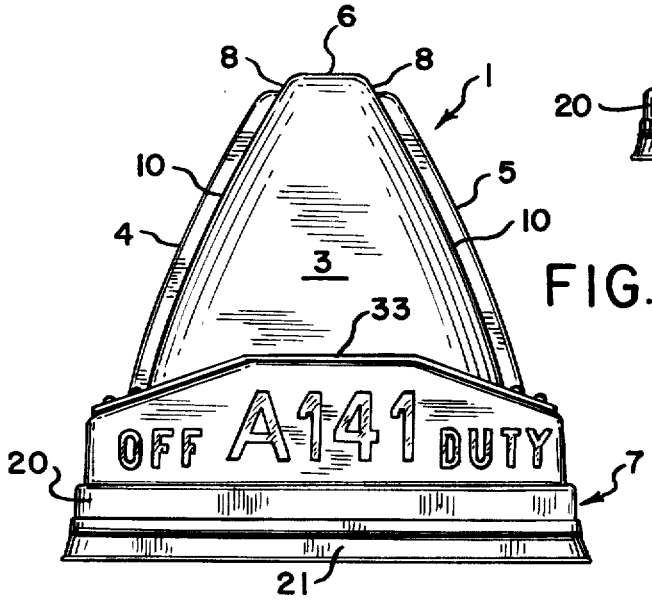
FIG. 4 is an elevated view of the rear end of the device.

Specifically, the display device 1 has a front end member 2 and a rear end member 3 which are generally triangular in configuration. A first side 4 and a second side 5 are supported between the front and rear end members 2, 3. The device defines a top portion 6 and a bottom portion 7. Each side 4, 5 has an upper end 8 which is joined at the top portion 6 of the device and a lower end 9 which is joined to the bottom portion 7 of the device and is supported by the front and rear end along edges 10. As can be seen in FIGS. 1, 2 and 4 the sides 4, 5 slope generally away from each other toward the bottom portion 7. These sides 4, 5 further have a convex configuration between the upper end 8 and the lower end 9, as seen in FIGS. 2 and 4, which enhances the view of the sides for the public. With this configuration the advertisement can be laid on to the sides 4 and 5 by adhesive means and displayed to the general public as the taxicab goes about its commercial activity.

A fluorescent tube 11 is located approximately midway between the top portion 6 and the bottom portion 7 and the two sides 4, 5. The fluorescent tube is connected to an appropriate power source which is remotely controlled for turning the fluorescent tube on and off as desired. The particulars of the power source and its remote control device are not disclosed in the drawings as they can be readily incorporated by one skilled in the art without further discussion. By having the fluorescent tube 11 located in this manner the advertisements which are supported on the surfaces of sides 4, 5 are illuminated from within and are provided with substantially an equal amount of illumination for every portion of the surface of sides 4, 5. This configuration insures that every portion of the surface is properly illuminated for enhancing viewing of the advertisement by the general public. Although in the embodiment shown a fluorescent tube is used, any elongated illuminating member can be employed to achieve the desired distribution of light.

Figure 3:
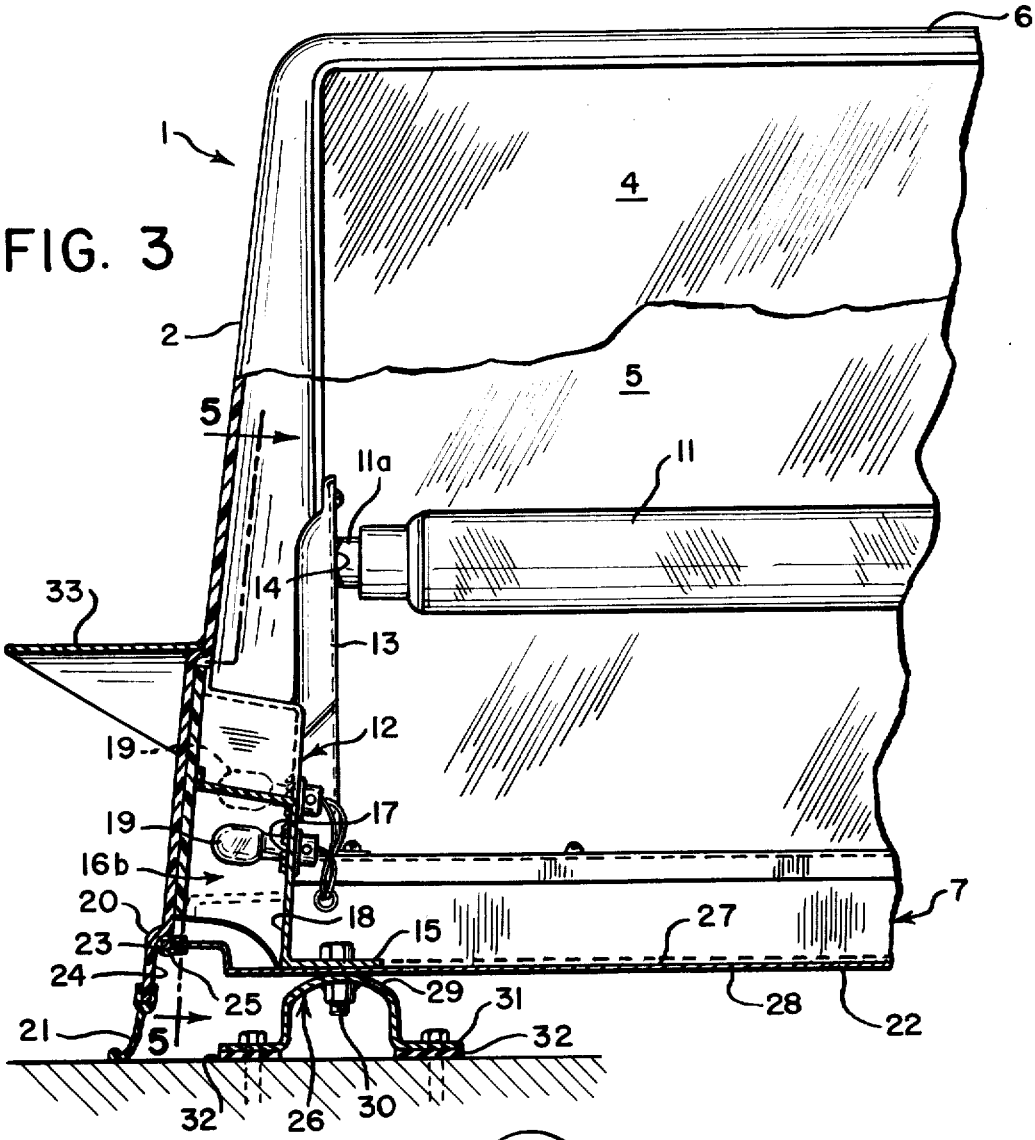
FIG. 3 is a side view of the display device with a portion cut away exposing internal elements of the device.
Figure 5:
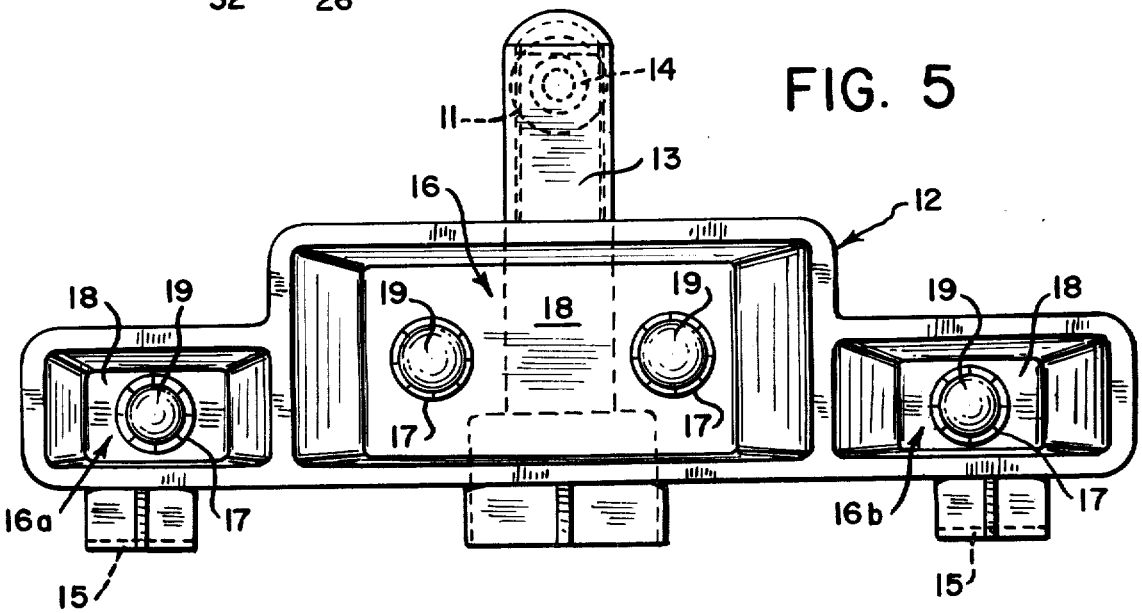
FIG. 5 is a sectional view of the device as shown in FIG. 3 taken along line 5—5.

A bracket 12 is located at each end of the display device and defines means for supporting the fluorescent tube 11 as well as means for illuminating the front and rear end members 2, 3. The bracket 12 includes a vertical support 13 which defines a socket 14 for receiving the ends 11*a* of fluorescent tube 11. Extending from the bracket 12 is a bracket flange 15 which is secured to bottom portion 7 as can be seen in FIG. 3. The bracket 12 also defines box-like enclosures 16 configured to receive illuminating means for illuminating information bearing surfaces on the front and rear end members 2, 3 of the device. As can be seen in FIG. 5, there are three enclosures or chambers, 16, 16*a*, 16*b*; a larger enclosure 16 in the center with two smaller enclosures 16*a*, 16*b* extending from each side thereof. Each of these enclosures has one side which is completely open and registers with the information on the front and rear end members 2, 3 of the display device.

In viewing FIG. 2 and FIG. 5 together it can be seen that the larger enclosure 16 registers with the term "taxi" in the center section of the front end portion while the smaller enclosures register with the terms "off duty" at the end sections of the front end. A similar registration of the enclosures occurs with respect to the rear end of the display device except the larger enclosure 16 registers with the medallion number. The enclosures **16, 16*a*, 16*b* define light sockets 17 in the rear wall 18 opposite the open side for receiving light bulbs 19 as shown in FIG. 3. As with the fluorescent tube 11, the light sockets 17 are connected to appropriate power sources and control means such that the light bulbs 19 in the center enclosure 16 can be operated independently of the light bulbs in the smaller enclosures 16*a*, 16*b*. In this manner, some information can be illuminated independently of the other since the light generated by the bulbs will not pass from one enclosure to another. Thus, when the "taxi" sign is illuminated the "off duty" sign can be off and vice versa. In the alternative the power source and control means can be incorporated to provide power to all the bulbs simultaneously or any other combination desired. In the preferred embodiment herein the bracket 12 with the enclosures 16, 16*a*, 16*b* and the vertical support 13** are of a unitary molded structure which is economical to manufacture and facilitates ease in assembly.

The display device includes means for conforming the device to the shape of the roof of an automobile to which it is secured for insuring a snug fit between the roof and the device. Depending from the bottom portion 7 of the device is a skirt 20 which is slightly concave and configured to the shape of the roof of the automobile such that it will generally conform to the slightly convex surface of the roof when secured thereto. Depending from this skirt 20 is a flexible gasket 21 which is pressed against the roof of the car when the device is secured thereto. This prevents moisture and other elements from entering into the device. The bottom portion 7 of the display device includes a bottom plate 22 whose edges 23 are parallel to and in close proximity with internal surfaces 24 of the skirt. On the edges 23 of the bottom plate there is gasket 25 secured at the interface of the edges 23 and the internal surfaces 24 of the skirt. The gasket 25 is configured to snugly engage the internal surface 24 to further aid in preventing moisture and other materials from penetrating the device and possibly impairing its operation.

The display device is secured to the roof of the automobile by an adjustable U-clamp 26 which can be secured to the bottom plate 22 at any desirable position. As seen in FIG. 3 the bottom plate has an upper surface 27 and a lower surface 28. The U-clamp has a convex portion 29 which is secured to the lower surface 28 by bolt 30. Depending from the U-clamp are vertical sides from which extend flanges 31 bolted to the roof of the automobile. Intermediate the flanges 31 and roof are rubber pads 32 which absorb shock and vibration during the operation of the automobile and prevent excessive damage to the roof.

Above the information bearing portion on the front and rear end members 2, 3 of the device there is fixed a shield 33 which extends outwardly from the front and rear end members 2, 3. The shields protect the information on the front and rear end members from sun light or other glare to render the information more readily viewable by the general public.

In the embodiment described herein the front and rear end members 2, 3, the top portion 6, bottom portion 7 and the side portions 4 and 5 along with the skirt 20 is of a single unitary structure molded from plastic material, such as polyvinyl chloride or other similar material. This one piece structure and its cooperation with the gaskets 21 and 25 make it practically impossible for water, dirt or other particles to penetrate to the internal elements of the device. Thus, the operation life of the device is substantially lengthened due to the protection provided from weather, tampering or other elements which might interfere with its normal operation.

In securing the device to the top of the automobile, holes are drilled in the roof of the automobile to register with holes in the flanges of the U-clamp 26. The bottom plate 22 is then secured to the convex portion 29 of the U-clamp 26 by bolts 30. The unitary structure is then bolted to the peripheral portion of the plate by bolts 34 as shown in FIG. 1. The attachment of the device to the automobile in this manner is efficient but with enhancement of the avertisement being supported on surfaces 4 and 5 and providing protection to the internal elements of the device.

The display device discussed herein is one which is economical and efficient to manufacture and assemble and enhances the viewability of the information contained on the surfaces of the device. Further, the configuration is one which allows the device to be secured to any vehicle without fear of moisture or other materials penetrating into the device impairing its operation. By having the illuminating means located within the display device described above, not only is the advertisement displayed enhanced by the equal distribution of the light, but also the elements which make up the display device are substantially tamper proof. Thus the above device has superior advertising qualities as well as economy, simplicity and efficiency in operation.

I claim:

1. A display device for displaying information bearing materials for viewing comprising:

a. a first end member defining a front end;

b. a second end member defining a rear end, each said first and second end members including a surface for supporting said information bearing materials, sections of which cooperate with end illuminating means for illuminating said sections independently of each other such that as one section is illuminated, another section is generally unaffected by the section which is illuminated;

c. a pair of side members supported between said first and second end members, said side members disposed at an angle one to the other and also having a surface for supporting said information bearing materials, and each said side surface between an upper and lower end being generally outwardly convex;

d. a bottom member secured to each said side member and to said first and second end member;

e. a top portion likewise secured thereby defining a substantially closed member in said display device;

f. illuminating means disposed in said chamber comprising a substantially continuous source of illumination extending substantially from said front end to said rear end and located substantially midway between said other members and top portion for rear illumination by substantially an equal amount of lumens every portion of said side surfaces for ease in viewing the same and said information bearing materials thereon from a multitude of attitudes; and g. attachment means for attaching said display device to the roof of a vehicle, said attachment means being carried by said bottom member.

2. The display device according to claim 1 wherein said end illuminating means includes at least two chambers located behind and adjacent to said front and rear ends, respectively, said chambers being so configured so that illumination of one chamber occurs without affecting the adjacent chamber.

3. The display device according to claim 1 wherein said illuminating means includes three chambers generally cubical in configuration having five sides and being open along each information bearing surface, one chamber being substantially larger than the other two smaller chambers and located between the smaller chambers.

4. The display device according to claim 3 wherein the chambers are carried by a bracket having sockets for light bulbs to illuminate each information bearing surface, each said socket adapted to be connected to remote control power sources for operating the light bulbs independently of each other.

5. The display device according to claim 1 wherein a vertical bracket is attached to the back of the one chamber of each end illuminating means for supporting a socket, said sockets providing support for a fluorescent tube comprising said side illuminating means.

6. The display device according to claim 5 wherein the vertical bracket and the three chambers are of a single unitary construction secured to the bottom member of the display device.

7. The display device according to claim 6 wherein a skirt member extends vertically from the bottom member of the display device and is configured to conform to the shape of the roof of said vehicle such that the display device can be attached to any vehicle.

8. The display device according to claim 7 wherein a flexible gasket member extends downwardly from said skirt member for snugly engaging the roof surface of the vehicle when said display device is attached thereto for preventing moisture from entering into the device along the areas of engagement between the gasket member and the roof.

9. The display device according to claim 8 wherein a bottom plate is supported on said bottom member and extending toward said skirt member, and a second flexible gasket member, said second flexible gasket member supported on the bottom plate between the bottom plate and the skirt member for further preventing moisture from entering into the display device.

10. The display device according to claim 9 wherein said bottom plate has an upper surface and a lower surface, said means for attaching said display device to the roof of the vehicle including a U-clamp member which defines a convex portion and vertical portions which extend downwardly from said convex portion defining at their ends a horizontal flange portion, each said flange portion having a rubber cushion attached thereto between said flange and the roof of the vehicle, said flange portion having bolt means for securing the U-shaped clamp member to the roof of the vehicle, and means for attaching the U-clamp to the lower surface of the bottom plate.

11. The display device according to claim 10 wherein the front end and the rear end of the display device define shields which extend outwardly from the display device and protect the information bearing surfaces from extraneous reflections so that they can be more easily read.

12. The display device according to claim 11 wherein said rear end, said front end, said side members, and said skirt member are of a unitary structure made of a polyvinyl chloride, said unitary structure is secured to said bottom plate and cooperates with said second flexible gasket member to isolate internal elements of the display device from the external elements when the display device is secured to the roof of said vehicle.

13. A display device for displaying advertising information comprising:

a. a front end member of a generally triangular configuration;

b. a rear end member of a generally triangular configuration displaced from said front end member;

c. two side portions being supported and extending between said front and rear end members, said side portions being generally convex in configuration and having a surface for supporting advertising materials for viewing;

d. said display device defining a top portion and a bottom portion, said side portions being joined to each other at the top portion of the display device and sloping generally away from each other toward the bottom portion of the display device;

e. said display device having a skirt which depends from the bottom portion and extends entirely around the display device and configured to conform with the roof of a vehicle to which the display device can be secured;

f. a fluorescent tube supported midway between the side portions and the top portion and the bottom portion of the display device and extending substantially the entire length of the display device;

g. said fluorescent tube being supported by a bracket having a vertical support member which defines a socket for receiving ends of the fluorescent tube; said bracket further comprising three chambers, each chamber being open along information bearing surfaces of the front and rear end members and each chamber having a socket for receiving a light bulb along a wall opposite the information bearing surface; each said socket adapted to be connected to a power source and control means for operation of the light bulbs;

h. said bottom portion of said display device defining a plate having edges which are adjacent and parallel to the internal surface defined by said skirt, said skirt having depending therefrom a flexible gasket for engagement with the roof of the vehicle to prevent moisture and other materials from entering into the display device through the interface defined by the roof and flexible gasket, a second gasket being attached to the edges of said plate and engaging the internal surface of said skirt to further prevent moisture and other materials from entering into the display device;

i. said display device having attaching means for allowing said display device to be secured to the roof of any vehicle, said attaching means including U-clamp members having a convex surface which is secured at any desired location to a bottom surface of said plate, said U-clamp members defining vertical sides from which extend horizontal flanges, said horizontal flanges having a rubber cushion attached thereto between said horizontal flange and the roof of said vehicle, each said horizontal flange having means securing the U-clamp member to the roof of the vehicle; and j. said front end member, said rear end member, said side portions, said top portion and bottom portion and said skirt being of a unitary configuration formed of a polyvinyl chloride.

* * * * *